United States Patent [19]

Friedl et al.

[11] 3,973,749

[45] Aug. 10, 1976

[54] HOLLOW FORMWORK ELEMENTS FOR PRODUCING CONCRETE STRUCTURES

[75] Inventors: Franz Friedl, Vienna; Erich Köhler; Hans Höller, both of Pottschach; Franz Gebauer, Vienna, all of Austria

[73] Assignee: Semperit Aktiengesellschaft, Vienna, Austria

[22] Filed: May 22, 1974

[21] Appl. No.: 472,233

Related U.S. Application Data

[63] Continuation of Ser. No. 249,718, May 2, 1972, abandoned.

[30] Foreign Application Priority Data

May 5, 1971 Austria ..... 3928/71

[52] U.S. Cl. ..... 249/65; 249/178

[51] Int. Cl.[2] ..... B28B 7/32

[58] Field of Search ..... 249/65, 178

[56] References Cited

UNITED STATES PATENTS

| | | | |
|---|---|---|---|
| 1,600,353 | 9/1926 | Nose | 249/65 X |
| 2,485,898 | 10/1949 | Mathews et al. | 249/65 |
| 2,579,423 | 12/1951 | Ford | 249/65 |
| 2,949,658 | 8/1960 | Conn | 249/65 |
| 3,104,441 | 9/1963 | Smith | 249/65 |
| 3,352,529 | 11/1967 | Haas | 249/65 X |
| 3,648,963 | 3/1972 | Smith | 249/65 |

FOREIGN PATENTS OR APPLICATIONS

| | | | |
|---|---|---|---|
| 2,018,815 | 4/1970 | Germany | 249/65 |

*Primary Examiner*—Francis S. Husar
*Assistant Examiner*—Carl Rowold
*Attorney, Agent, or Firm*—Ernest F. Marmorek

[57] ABSTRACT

The present invention relates to reusable hollow formwork elements of elastic material which may be used for the concreting of pipelines, and which by filling with a gaseous or liquid medium, can be given compressive resistance. The invention also relates to a method of operating such formwork elements.

7 Claims, 5 Drawing Figures

HOLLOW FORMWORK ELEMENTS FOR PRODUCING CONCRETE STRUCTURES

This is a continuation of application Ser. No. 249,718, filed May 2, 1972, now abandoned.

BACKGROUND OF THE INVENTION

By way of formwork material for concreting purposes, wood, sheet metal and, more recently, flexible materials such as synthetic plastics material sheets or foamed synthetic materials, have been used. In order, however, to be able to use a flexible formwork skin, it is necessary to maintain the desired formwork shape by using internal spacers of suitable material. By the incorporation of spacers, however, so-called lost formwork, i.e. the synthetic plastics material formwork remains in situ in the concreted components.

On the other hand, so-called telescopic formwork arrangements of steel or light alloy are known, which are used in tunneling work and consist of a multipart formwork system arranged on a mobile assembly. The use of this kind of system makes it possible to build a tunnel lining in a continuous manner. The use of formwork sections of this kind or formwork elements which do not have a uniform, smooth surface, necessitates considerable subsequent work because the concrete surface has to have the flash witnesses removed from it. The use of formwork removal agents which are applied to the formwork before the concreting operations are commenced, although ensuring trouble-free removal of the formwork nevertheless means that subsequent treatment of the surface, at least at the points of connection, is essential.

Also known are tubelike or sacklike formwork arrangements for the concreting of ceilings and particularly for reinforced concrete ribbed ceilings, these arrangements being made of a slack, flexible material such as rubber tubing or sacking. Tubes of this kind can be operated by filling them with air, water or sand and providing a closable insert.

The tubes consist of a sheet of synthetic plastics material as the envelope with tensile tensioning inserts and stiffening inserts which are applied to fixing points and in this fashion ensure that a specific cross-sectional shape is maintained. Even under conditions of intensive maintenance, however, devices made of flexible material are subjected to relatively heavy wear because the tensioning inserts and reinforcing inserts make it very difficult to introduce the devices into position and align them and it is extremely difficult to re-use such hollow formwork elements. A great deal of extra labour is thus involved and efforts have therefore been made to use hollow elements of inexpensive material in order to use them at lost formwork. Quite apart from this, however, the compressive resistance of this kind of tube of synthetic plastics material foil, is too low to justify regarding such an element as a fullgrade piece of formwork.

SUMMARY OF THE INVENTION

An object of the invention is to overcome the drawbacks of known hollow formwork elements and to provide a formwork element of elastic material, which an element can be erected on site in its final form quite simply by filling it with a gaseous or fluid medium, and which element can also be positioned very simply.

The invention therefore consists in a re-usable hollow formwork element of elastic material, which element by filling it with a gaseous or liquid fluid medium can be given compressive resistance, comprising a formwork skin and internal walls attached thereto, said internal walls forming at least three separate cavities extending over the full length of the formwork element and the hollow element formed by the skin being closed at its ends by covers fitted with fluid valves.

One or more of the cavities can be arranged to have a circular cross-section in the filled state.

Preferably, the diameters of two cavities which are circular in the filled state are in the ratio of approximately 1:2. It has also been found convenient to attach the internal walls forming the cavities to one another over the full length of the formwork element at the common tangent or chord, with the cavities communicating with one another through one or more openings so that selected cavities can be filled with fluid meduim through a common valve.

From another aspect the invention consists in a method of operating the hollow formwork element wherein selected combinations of the cavities are filled with fluid medium independently of one another through respective valves, the formwork skin being made to adapt the required profile by adjusting the pressure in the cavities. To achieve a substantially elliptical or oval cross-section two cavities which have a circular cross-section in the filled state, are maintained at the same pressure, while the remaining cavity or cavities is or are maintained at a lower pressure. For example, a pressure difference of between 0.1 and 0.5 atm may be provided.

The hollow formwork element is preferably made from a fabric with an oil-resistant coating e.g. a cotton fabric or a polyester fibre fabric with a coating of a butadiene-acrylonitrile copolymer of a layer of poly-2-chlorobutadiene (Neoprene). Thus, normally rubberized fabrics which are designed for engineering applications, can be used. The formwork skin must be made of oil-resistant material because it is essential to use formwork release agent based upon lubricating oils in order to prevent the concrete from adhering to the formwork.

This kind of formwork element can, for example, be manufactured as follows.

First, two cylinders closed at their ends, are manufactured from rubberized fabric and attached to one another by bonding, whereafter they are covered by an envelope wall which serves as a formwork skin. The open hollow element obtained in this way is then closed off at its ends by dish-shaped covers, each of which contains a valve.

The application of re-usable hollow formwork elements is indicated whereever the in situ building of concrete pipes is required. The formwork in accordance with the invention can be used to build pipelines of all kinds, including curved ones. It is possible to produce different profiles using one and the same element, merely by altering and adapting the pressures in the cavities provided. The profile can be varied in this context from the elliptical to the circular. With an element of this kind it is possible without particular difficulties, to carry out improvement works, the element being placed in a pipe which is to be improved and concrete introduced into the interspace formed between the envelope wall of the element and the pipe.

Using a formwork element in accordance with the invention it is even possible to take account of changes in profile during the manufacture of a pipeline. These elements are particularly suitable for application at points where access is difficult and space restricted.

In building concrete pipelines using a formwork element in accordance with the invention, it is first of all necessary to provide a suitable base or foundation. For example such a base or foundation is preliminarily produced by concreting or a substrate suitable to perform this function is laid down. Then external formwork and possible reinforcing is introduced. The hollow formwork element is then inserted and inflated using compresssed air and built-in pressure-reducer valves may be provided to ensure that the correct pressure is established. In this context, in order to achieve an elliptical or oval cross-section, of the kind often required in ducting, the pressure ratio is so contrived, that the two circular tubes are maintained at the same pressure while the remaining is inflated to a lower pressure.

During the concreting operations the hollow element is held down from the top to prevent it floating off. After the concrete has cured, the compressed air is blown off from the hollow formwork element and the element, which then lies slack in the finished pipeline, can be withdrawn. It is possible too, of course, simply to blow off a small quantity of air and to shift the element onwards by a distance corresponding to the concreted length of pipe.

BRIEF DESCRIPTION OF THE DRAWINGS

Exemplary embodiments of the invention will now be described with reference to the drawings forming a part of this Specification, in which.

DETAILED DESCRIPTION OF THE PREFERRED EMBODIMENTS

Figure 1:
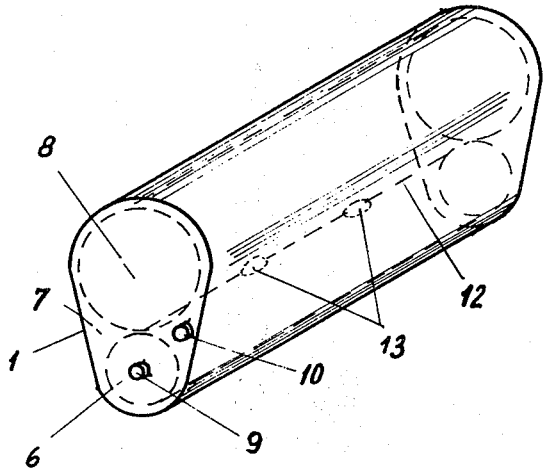
FIGS. 1 and 2 show a hollow formwork element in a perspective view and in section along the longitudinal axis.
Figure 2:
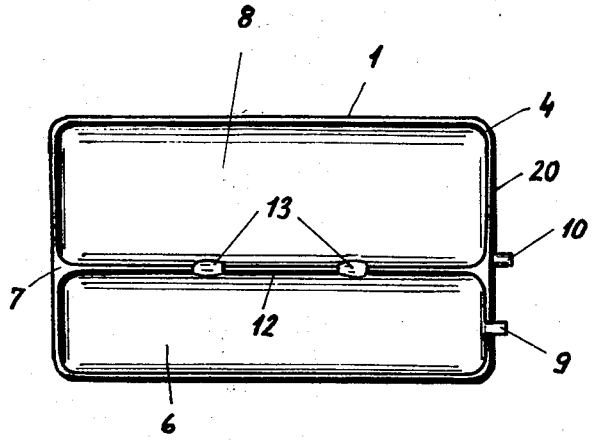

As shown in FIG. 1, a hollow formwork element comprises two elongated tubes 6 and 8 which in the filled or inflated state have an approximately circular cross-section and whose diameters are approximately in the ratio 1:2. The two tubes are attached to one another along the line 12 and transfer orifices 13 for the filling medium, are provided therebetween. The two tubes are surrounded by a formwork skin 1 of rubberized fabric having a tearing strength of around 320 Kg per cm. The tubes 6 and 8 are provided at their ends, as shown in FIG. 2, with caps 4 to close them off. One of these caps contains a common filling and blow-off valve 9 for both tubes. The filling medium, e.g. compressed air, passes unimpededly through the openings 13 from one tube to the other. The intermediate space, or spaces 7 which are formed between the formwork skin 1 and the tubes 6 and 8, is or are inflated or filled through the valve 1o. The valve 1o, as FIG. 2 shows, is contained in one of the two end covers 2o of the formwork skin 1. Consequently, the cavity 7 between the tubes 6 and 8 and the formwork skin 1 are filled with the pressurized medium.

Figure 3:
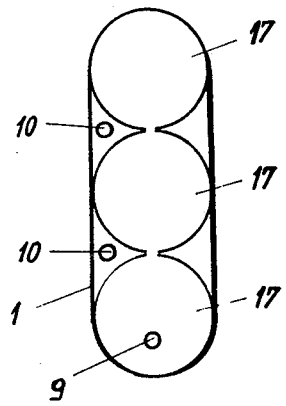
FIGS. 3 to 5 show further embodiments of the hollow formwork in section.
Figure 4:
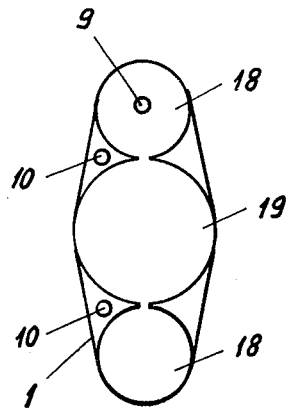

In the embodiment shown in FIG. 3, three tubular elements 17 of the same diameter, are arranged one above the other. FIG. 4 on the other hand, shows a substantially elliptical hollow formwork element comprising a central tubular element 19 with a diameter at most equal to the minor axis of the desired elipse to which two tubular elements 18 of smaller diameter are attached.

Figure 5:
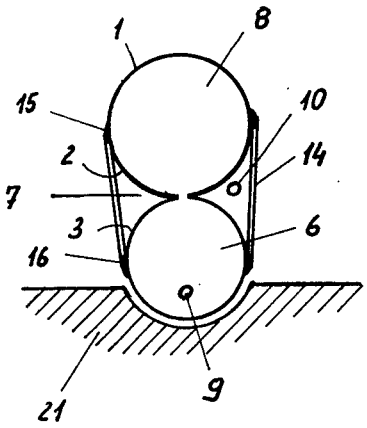

FIG. 5 shows a further embodiment of a hollow formwork element in accordance with the invention in operation. Set up on a pre-concreted foundation 21, there is shown an approximately elliptical hollow formwork element comprising a formwork skin 1. The internal wall parts 2 and 3 do not themselves define closed cavities but are attached to the formwork skin 1 along lines 15 and 16, to form corresponding cavities 6, 7 and 8, and between these two attachment lines 15 and 16, the formwork skin 1 is reinforced by a reinforcing insert 14. After the placing of the hollow formwork element on the pre-concreted foundation, the two tubes 6 and 8 which can be commonly inflated by a valve 9, are inflated with compressed air to around 1.375 atm, while the remaining cavity 7, between the formwork skin 1 and the two tubes 6 and 8, is inflated through the valve 1o to about 1.1 atm. A formwork with an approximately oval cross-section is thus produced. The hollow formwork element is subsequently surrounded with concrete in the desired fashion and left in the cavity thus formed, until the concrete is cured. Then, the pressure in the two elongated tubes of circular cross-section is reduced slightly so that the hollow formwork element lifts away from the inner wall of the pipe which has been thus formed and can be moved longitudinally for further use.

What we claim as our invention and desire to secure by Letters Patent of the United Stats is:

1. A re-usable hollow elongated casing formwork element of elastic material, adapted for placement into a concrete pipe line and adapted to be rendered pressure resistant by filling it with a gaseous or liquid fluid medium, comprising an elongated, elastic outer casing and at least two elongated elastic hollow cylinders positioned side-by-side within and extending over the entire length of said outer casing whereby at least two elongated communicating cavities are formed intermediate said outer casing and said cylinders and are adapted to be pressurized by said fluid medium, at least two of said hollow cylinders being interconnected by openings therebetween whereby said fluid medium can communicate between said two interconnected hollow cylinders, a first valve for introducing said fluid medium into one of said two hollow cylinders for pressurizing both said cylinders and a second valve for introducing said fluid medium into one of said hollow cavities for pressurizing both said cavities.

2. The formwork element as claimed in claim 1 wherein said cylinders each have a circular cross-section in the pressurized condition.

3. The formwork element as claimed in claim 2 wherein the diameters of said circular cross-section cylinders are substantially in the ratio of one to two.

4. The formwork element as claimed in claim 1 wherein there are three of said cylinders lying side-by-side, the central one of said three cylinders being in fluid communication with said two other cylinders.

5. The formwork element as claimed in claim 4 wherein said three cylinders have approximately the same ciameter in the pressurized condition.

6. The formwork element as claimed in claim 4 wherein the central one of said three cylinders has a larger diameter than said two other cylinders in the pressurized condition.

7. The formwork element as claimed in claim 2 wherein there is further included a pair of reinforcements which are secured to said outer casing portions to thereby define said cavities.

* * * * *